US005833273A

United States Patent [19]

Strenk et al.

[11] Patent Number: 5,833,273

[45] Date of Patent: Nov. 10, 1998

[54] COMPOSITE BUSINESS FORM FOR USE AS A TAG AND LABEL

[75] Inventors: Theodore M. Strenk, Philadelphia; Daniel V. LaMay, Feasterville, both of Pa.

[73] Assignee: Avery Dennison, Pasadena, Calif.

[21] Appl. No.: 835,882

[22] Filed: Apr. 8, 1997

[51] Int. Cl.[6] ..... B42D 15/00

[52] U.S. Cl. ..... 283/67; 283/81; 283/105; 283/101

[58] Field of Search ..... 281/2, 5, 38; 283/81, 283/79, 80, 101, 103, 105, 61, 62; 40/299, 630, 638

[56] References Cited

U.S. PATENT DOCUMENTS

| | | | |
|---|---|---|---|
| Re. 30,958 | 6/1982 | White . | |
| 1,796,894 | 3/1931 | Pendergast . | |
| 4,726,131 | 2/1988 | Cass . | |
| 4,927,179 | 5/1990 | Ehret et al. . | |
| 4,995,642 | 2/1991 | Juszak et al. . | |
| 5,031,939 | 7/1991 | Webendorfer et al. . | |
| 5,348,780 | 9/1994 | Boggs et al. | 283/105 X |
| 5,423,139 | 6/1995 | Feldman . | |
| 5,449,201 | 9/1995 | Miller et al. . | |
| 5,482,753 | 1/1996 | Langan et al. | 283/105 X |
| 5,520,990 | 5/1996 | Rotermund | 283/105 X |
| 5,585,156 | 12/1996 | Fontana | 283/105 X |
| 5,601,313 | 2/1997 | Konkol et al. | 281/2 X |

*Primary Examiner*—Willmon Fridie, Jr.
*Attorney, Agent, or Firm*—Spencer & Frank

[57] ABSTRACT

A composite business form includes a face sheet having first and second sides. The first side has first and second regions, each region being adapted for receiving variable print information. A coating of pressure-sensitive adhesive is disposed on the second side of the face sheet. A liner has one side attached to the second side of the face sheet by the adhesive. The one side of the liner has a first portion adapted to be releasably fixed to the adhesive in an area that is at least co-extensive with the first region of the face sheet, and a second portion adjacent to the first portion that is adapted to be permanently fixed to the adhesive in an area that is at least co-extensive with the second region of the face sheet. The business form has a first line of perforations between the first and second regions so that the second portion of the liner permanently fixed to the second region of the face sheet comprises a unit that is separable from the first portion of the liner and the first region of the face sheet.

26 Claims, 2 Drawing Sheets

COMPOSITE BUSINESS FORM FOR USE AS A TAG AND LABEL

BACKGROUND OF THE INVENTION

The present invention relates to business forms and, in particular, to tags and labels used in the retail apparel industry.

Apparel manufacturers apply a tag containing variable print information, such as size, fabric content, and price, to each garment, typically by hanging the tag with the use of a cable or fastener attached with a SWIFTACH device, which is registered trademark of Avery Dennison, to the garment. A companion label containing the same information, and possibly additional information, for example, shipping information, concerning the same garment is applied to a protective polyethylene bag encasing the garment during shipment with the use of a pressure-sensitive adhesive. Although the information on the tag and the label for a particular garment must match, typically, the tag and the label are printed at different times. This raises the possibility of an error in that either the printing information will not be input correctly for either the tag or the label, or, even if the information is printed correctly, there can be error introduced in matching up corresponding labels and tags for the respective garments.

SUMMARY OF THE INVENTION

It is an object of the invention to provide a composite business form, in particular, for use as a tag and label, that is constructed so that errors of the foregoing type are minimized.

The above and other objects of the invention are accomplished by the provision of a composite business form, comprising: a face sheet having first and second sides, the first side having first and second regions, each region being adapted for receiving variable print information; a coating of pressure sensitive adhesive disposed on the second side of the face sheet; and a liner having one side attached to the face sheet by the adhesive, the one side of the liner having a first portion adapted to be releasably fixed to the adhesive in an area that is at least co-extensive with the first region of the face sheet and a second portion adjacent to the first portion that is adapted to be permanently fixed to the adhesive in an area that is at least co-extensive with the second region of the face sheet, the form having a first line of perforations between the first and second regions so that the second portion of the liner permanently fixed to the second region of the face sheet comprises a unit that is separable from the first portion of the liner releasably fixed to the first region of the face sheet.

In a preferred method of using the business form of the invention, the first region of the face sheet constitutes a label and the second region with its permanently fixed liner constitutes a tag. The tag and label are printed with matching information prior to separation. At the time the tag and label are separated, the tag is connected to an article, such as a garment, and the label is attached to a protective material covering the article, for example, a polyethylene bag, encasing the garment. The tag may be connected to the garment by hanging the tag with the use of a cable affixed to the garment. The label is affixed to the polyethylene bag by removing the portion of the liner releasably fixed to the adhesive on the back of the label and pressing the label, via the adhesive, onto the bag.

Preferably, the tag and the label are printed at the same time to minimize errors in printing. Further, since the tag and label remain connected together until shortly before being connected to the garment and the garment bag, respectively, the possibility of mixing up the tag and label for a particular garment is also minimized.

To facilitate removal of the liner from the label, the portion of the liner covering the label is coated with a release material, such as silicone 22, having, for example, an L3 release value relative to the adhesive. On the other hand, the portion of the liner fixed to the second region of the face sheet is not coated with silicone, so this portion of the liner becomes permanently fixed to that area of the face sheet and forms therewith a unit or tag that is separable from the label portion of the face sheet. Preferably, the separable unit or tag is provided with a hole near one end of the tag so that a cable may be threaded therethrough for hanging the tag on a garment. The tag is adapted to be printed on both sides whereas the label is printed only on the front side of the face sheet.

According to another aspect of the invention there is provided a method of making a business form, comprising: providing a roll of stock paper to be used as a face sheet, the face sheet having a front side that is adapted to be printed and a rear side; applying the adhesive to the rear side of the face sheet; providing a roll of liner material with a release coating applied to a first longitudinal region of the liner material so as to leave a second longitudinal region adjacent the first longitudinal region that has no release coating, the release coating having a release value with respect to the adhesive for allowing release of the first longitudinal region from the adhesive, wherein the second longitudinal region will permanently adhere to the adhesive; and pressing the liner onto the rear side of the face sheet along the entire length of the roll of stock paper to create a second roll of stock material comprising the face sheet with the liner having its first longitudinal portion releasably adhered to the face sheet and the second adjacent longitudinal portion permanently fixed to the face sheet by the adhesive.

Other features and advantages of the invention will become apparent from the following detailed description of the invention in conjunction with the accompanying drawings.

DETAILED DESCRIPTION OF THE INVENTION

Figure 1:
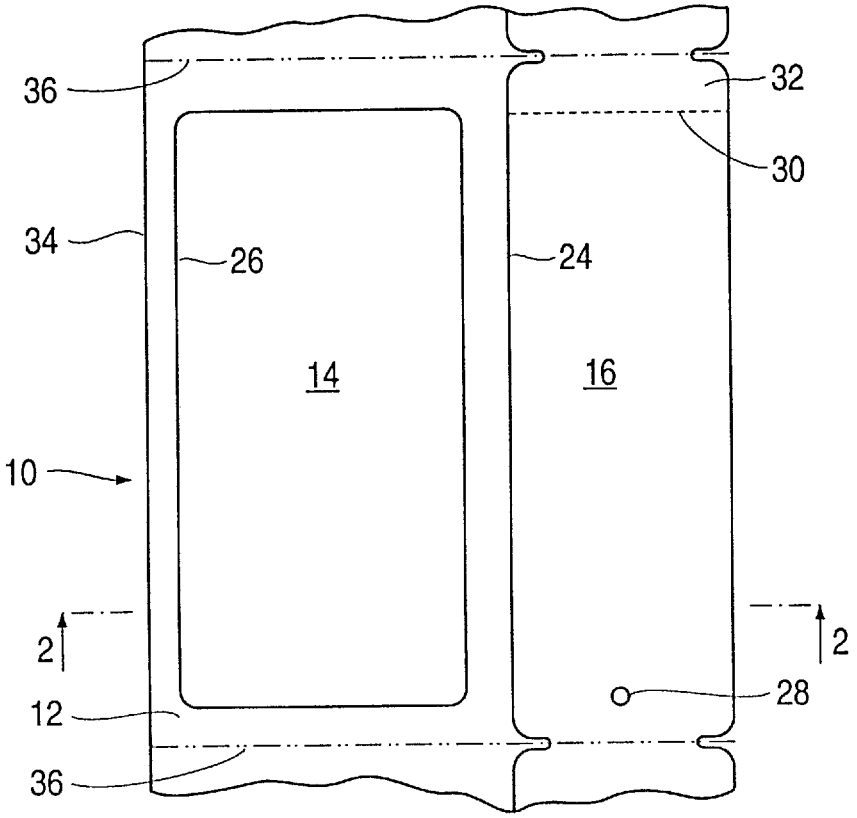
FIG. 1 is a plan view of the front side of a business form according to the invention.
Figure 2:
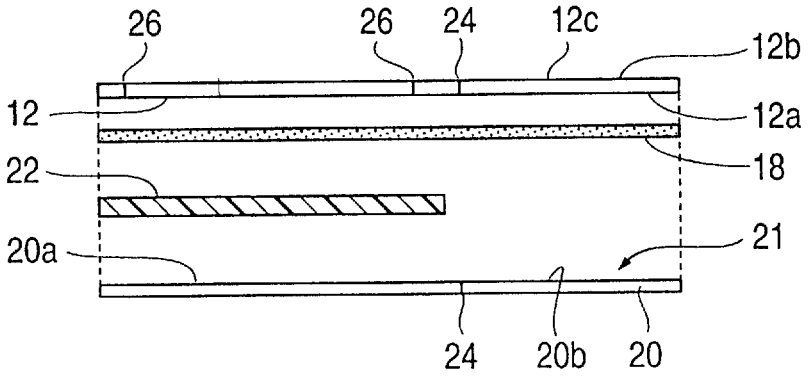
FIG. 2 is an exploded cross-section of FIG. 1 along the sectional line 2—2.

Referring to FIG. 1, there is shown, in accordance with the invention, the front side of a composite business form 10 which has a face sheet 12 and is configured to form a label 14 and a tag 16. FIG. 2 shows an exploded sectional view along section line 2—2 of FIG. 1 which shows the various layers of the business form. The layers are shown with an exaggerated thickness for purposes of illustration. Face sheet 12 has applied on its rear side 12*a* a pressure-sensitive adhesive 18, which may be a hot-melt permanent adhesive, for example, S246 FASSON which is a registered mark of Avery Dennison Company. A liner 20 has a coating of a release material 22, such as silicone, applied to a first longitudinal region 20*a* on a rear surface 21 of the liner 20. A second longitudinal region 20*b* of the rear side of liner 20 has no release material applied to it. When the liner is pressed against the rear surface 12*a* of face sheet 12, the liner is adhered to face sheet 12 by adhesive 18. However, the first longitudinal region of liner 20 is releasably attached to face sheet 12 due to the silicone release material. Preferably, the silicone release material has a release value of L3, which is an industry standard. The second longitudinal region 20*b* of liner 20 is permanently fixed to face sheet 12 by adhesive 18 because the release material is omitted from this portion of the liner.

The business form 10 shown in FIG. 1 is scored with a line of perforations 24 such that the tag 16, comprised of a region 12*c* of liner 12 (see FIG. 2) and the permanently adhered region 20*b* of the liner 20 is separable from the remainder of the business form. Preferably, the side of face sheet 12 to the left of the liner perforations 24 in FIG. 1 has an underscore 26 in the shape of, for example, a rectangle, to form the label 14 which can be peeled away from the releasably attached region 20*a* of liner 20.

The front side 12*b* of face sheet 12 is adapted to be printed with variable print information. For example, when the business form of the invention is intended to be used to identify a garment, the label 14 and tag 16 are imprinted with common variable print information, such as garment size, color, fabric content, price, etc.

In one exemplary implementation of the above business form, face sheet 12 consists of an 8-point paperboard coated on front side 12*b* with a protective finish specific for press and/or thermal transfer printing and coated on its rear side 12*a* with an adhesive, as discussed above. The liner 20 is a 50# liner material treated with silicone, as discussed above.

Tag 16 is shown as including a hole 28 for the purpose of threading a cable so that the tag 16 may be attached to an article, such as a garment, for example by attaching the tag to the garment with the cable. Further, tag 16 may additionally be provided with a line of perforations 30 to form a selectively separable portion 32 of tag 16 on which, for example, the price of an article may be imprinted.

In practice, a continuous web 34 of composite business forms, which may be wound in a roll for subsequent processing, is formed by applying the adhesive 18 to the rear side 12*a* of face sheet 12, and pressing the silicone-treated liner 20 against the rear surface 12*a* of face sheet 12 so that the first longitudinal region 20*a* of liner 20 becomes releasably attached to the rear side 12*a* of face sheet 12 in an area that is at least co-extensive with the region of label 14, and the second longitudinal region 20*b* of liner 20 becomes permanently fixed to the rear side 12*a* of face sheet 12 in an area that is at least co-extensive with the region of the face sheet 12 that forms the front side of tag 16.

A roll of stock material comprising face sheet 12 and liner 20 attached thereto, as described above, may then be passed through a dye to create the line of perforations 24, the underscore 26, and the line of perforations 30 so as to form a continuous web of composite business forms, each having a label 14 and tag 16, as shown in FIG. 1.

Thereafter, the roll of stock material having the perforations and score lines, as shown in FIG. 1, may be passed through a thermal transfer or laser printer for printing the common variable information on the label and tag portions of the face sheet. Preferably, immediately after the printing of each composite business form, the web is cut transversely along lines 36 so as to form individual composite business forms containing common variable print information on the corresponding label and tag portions of each form.

When used in connection with apparel being prepared for sale, wherein each garment is disposed in a protective polyethylene bag, the label and tag portions of the composite business form remain attached to one another until the time of application. At that time, tag 16 is separated at the line of perforations 24 from label 14 and attached to the garment with a cable, as is known in the art. Label 16 is then peeled from its backing or liner and attached to the polyethylene bag encasing the garment. The pressure-sensitive adhesive on the rear side of label 14 readily adheres to the polyethylene bag with a modest amount of pressure.

Since label 14 and tag 16 are printed at the same time, the possibility of an error in the information printed thereon is minimized. Furthermore, since the tag and label are not separated from one another until applied to a garment and its protective cover, the chance of mixing up labels and tags is also minimized.

Figure 4:
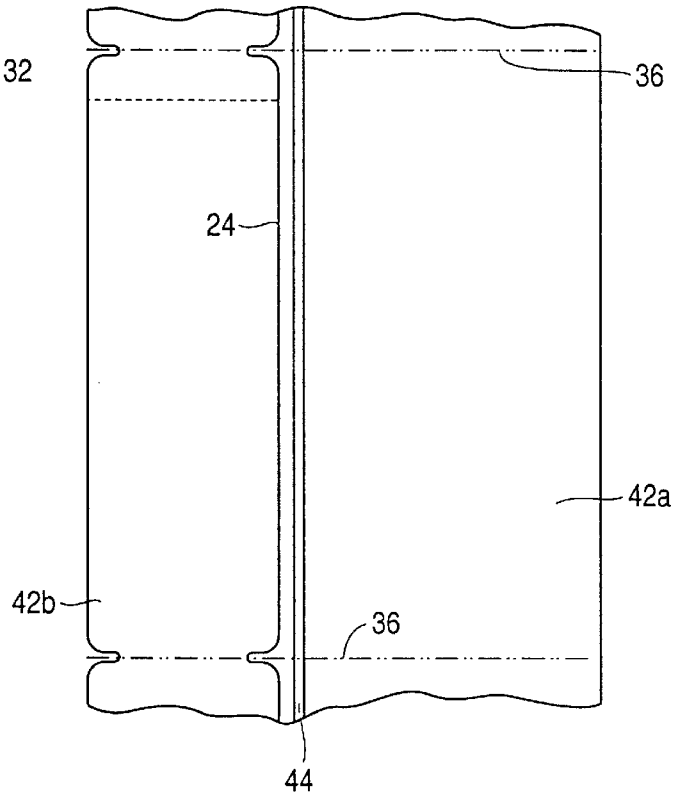
FIG. 4 is a plan view of the rear side of the business form shown in FIG. 3.
Figure 3:
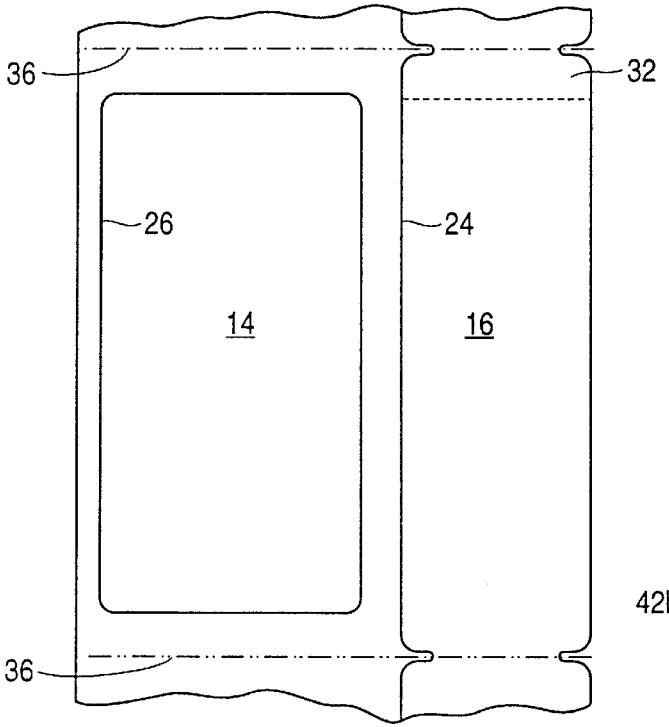
FIG. 3 is a plan view the front side of a second embodiment of the business form according to the invention.
Figure 5:
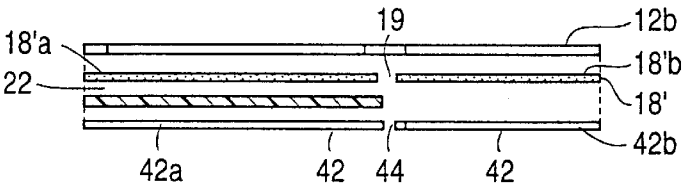
FIG. 5 is an exploded cross-section of FIG. 3 along the sectional line 5—5.

FIGS. 3 to 5 show an alternative embodiment of the invention. In FIGS. 3 to 5, like parts with respect to FIG. 1 are given the same reference numerals. The difference between the embodiment of FIGS. 3 to 5 and that of FIG. 1 is that in FIGS. 3 to 5 the liner 42 is a split liner comprised of a first piece 42*a* and a second piece 42*b* separated by a gap 44. In this case the silicone release material 22 is applied only to the rear side of liner piece 42*a*. Additionally, the layer of adhesive 18' is applied in a pattern to the rear side of face sheet 12 so as to provide a longitudinal gap 19 between two longitudinal regions 18*a*' and 18*b*' of the adhesive layer 18'. The two pieces 42*a* and 42*b* of liner 42 are then pressed onto the rear side of face sheet 12 in a manner so as to preserve the gap 44 so that the two pieces of the liner do not overlap. The gap 19 in adhesive layer 18' is aligned with gap 44 and ensures that no dust or dirt will attach to this portion of the rear side of face sheet 12 and also that the rear side of face sheet 12 will not stick to the front surface of face sheet 12 when wound into a roll, as discussed above.

The split liner configuration, as shown in FIGS. 3 to 5, is a suitable implementation of the invention when a continuous web having a single row of side-by-side labels and tags, as shown in FIGS. 3 and 4, is formed. However, the manufacturing throughput for creating the composite business forms, according to the invention, may be increased by dye-pressing a plurality of connected rows of composite tag and label forms across the width of a web. In this case, it is preferable to use a single liner which has its rear side patterned with alternate longitudinal regions containing silicone release material.

It is understood that various other modifications will be apparent to and can readily be made by those skilled in the art, without departure from the scope and spirit of this invention. Accordingly, it is not intended that the scope of the claims appended hereto be limited to the description set forth herein, but, rather, that the claims be construed as encompassing all of the features of patentable novelty that reside in the present invention, including all of the features that would be treated as equivalents thereof by those skilled in the art to which this invention pertains.

What is claimed is:

1. A composite business form, comprising:

a face sheet having first and second sides, the first side having first and second regions, each region being adapted for receiving variable print information;

a coating of pressure sensitive adhesive disposed on the second side of the face sheet; and a liner having one side attached to the second side of the face sheet by the adhesive, the one side of the liner having a first portion adapted to be releasably fixed to the adhesive in an area that is at least co-extensive with the first region of the face sheet and a second portion adjacent to the first portion that is adapted to be permanently fixed to the adhesive in an area that is at least co-extensive with the second region of the face sheet, the business form having a first line of perforations between the first and second regions so that the second portion of the liner permanently fixed to the second region of the face sheet comprises a unit that is separable from the first portion of the liner and the first region of the face sheet.

2. The business form according to claim 1, wherein the first portion of the one side of the liner has a silicone coating to facilitate release of the first portion from the adhesive.

3. The business form according to claim 1, wherein at least the second portion of the liner has a side opposite the one side of the liner that is adapted for being printed.

4. The business form according to claim 1, wherein the unit has a second line of perforations to form a tag that is separable from a remaining portion of the unit.

5. The business form according to claim 1, wherein the unit has a hole for receiving a cable for attaching the unit to another article.

6. The business form according to claim 1, wherein the liner is a split liner, comprising first and second pieces corresponding to the first and second portions, respectively, with a gap between the first and second pieces.

7. A method of providing a tag for connection to an article and a companion label for application to a cover enclosing the article, comprising:

utilizing the composite business form according to claim 1, with the unit comprising a tag and the first region of the face sheet comprising a label;

printing the first and second regions of the face sheet with common information prior to separating the tag from the label;

separating the tag from the label at the first line of perforations;

connecting the tag to the article; and removing the releasable liner from the label and attaching the label via the adhesive to the cover enclosing the article.

8. The method according to claim 7, wherein the printing step includes printing the tag and the label at the same time.

9. The method according to claim 7, wherein the connecting step includes connecting the tag to the article with a cable.

10. A method of making business forms, comprising:

providing a roll of stock paper to be used as a face sheet, the face sheet having a front side that is adapted to be printed and a rear side;

providing a roll of liner material;

applying adhesive to the rear side of the face sheet;

providing the roll of liner material with a release coating applied to a first longitudinal region of the liner material so as to leave a second longitudinal region adjacent the first longitudinal region that has no release coating, the release coating having a release value with respect to the adhesive for allowing release of the first longitudinal region from the adhesive, wherein the second longitudinal region will permanently adhere to the adhesive; and pressing the liner onto the rear side of the face sheet along the entire length of the roll of stock paper to create a second roll of stock material comprising the face sheet with the liner having its first longitudinal portion releasably adhered to the face sheet and the second adjacent longitudinal portion permanently fixed to the face sheet by the adhesive.

11. The method according to claim 10, further comprising:

pressing the stock material of the second roll with a dye to create a line of perforations between the first and second longitudinal regions along the length of the second roll.

12. The method according to claim 11, further comprising printing common variable information on a front surface of the face sheet on both sides of the line of perforations and cutting the second roll after each printing of variable information to provide composite forms.

13. A composite business form, comprising:

a face sheet having first and second sides, the first side having first and second regions, each region being adapted for receiving variable print information;

a coating of pressure sensitive adhesive disposed on the second side of the face sheet; and a liner having one side attached to the second side of the face sheet by the adhesive, the one side of the liner having a first portion adapted to be releasably fixed to the adhesive in an area that is at least co-extensive with the first region of the face sheet and a second portion adjacent to the first portion that is fixed to the adhesive in an area that is at least co-extensive with the second region of the face sheet, the business form having a first line of perforations between the first and second regions so that the second portion of the liner fixed to the second region of the face sheet comprises a unit that is separable from the first portion of the liner and the first region of the face sheet.

14. The composite business form according to claim 13, including means for facilitating removal of a section of the first region of the face sheet from the first portion of the liner material.

15. The composite business form according to claim 14, wherein the facilitating means comprises an underscore in the face sheet defining the section for removal.

16. The business form according to claim 13, wherein the first portion of the one side of the liner has a silicone coating to facilitate release of the first portion from the adhesive.

17. The business form according to claim 13, wherein at least the second portion of the liner has a side opposite the one side of the liner that is adapted for being printed.

18. The business form according to claim 13, wherein the unit has a second line of perforations to form a tag that is separable from a remaining portion of the unit.

19. The business form according to claim 13, wherein the unit has a hole for receiving a cable for attaching the unit to another article.

20. The business form according to claim 13, wherein the liner is a split liner, comprising first and second pieces corresponding to the first and second portions, respectively, with a gap between the first and second pieces.

21. A method of providing a tag for connection to an article and a companion label for application to a cover enclosing the article, comprising:

utilizing the composite business form according to claim 13, with the unit comprising a tag and the first region of the face sheet comprising a label;

printing the first and second regions of the face sheet with common information prior to separating the tag from the label;

separating the tag from the label at the first line of perforations;

connecting the tag to the article; and removing the releasable liner from the label and attaching the label via the adhesive to the cover enclosing the article.

22. The method according to claim 21, wherein the printing step includes printing the tag and the label at the same time.

23. The method according to claim 21, wherein the connecting step includes connecting the tag to the article with a cable.

24. A method of making business forms, comprising:

providing a roll of stock paper to be used as a face sheet, the face sheet having a front side that is adapted to be printed and a rear side;

providing a roll of liner material having opposite sides;

applying the adhesive to the rear side of the face sheet;

applying a release coating to one of the opposite sides of the liner material, the release coating having a release value with respect to the adhesive for allowing release of the liner material from the adhesive;

pressing the liner material onto the rear side of the face sheet along the entire length of the roll of stock paper to create a second roll of stock material;

pressing the stock material of the second roll with a dye to create a line of longitudinal line of perforations to define first and second longitudinal regions along the length of the second roll; and providing the first longitudinal region of the face sheet with means for facilitating removal of a section of the first longitudinal region from the liner material.

25. The method according to claim 24, wherein the step of providing means for facilitating comprises providing the first region of the face sheet with an underscore to define the section for removal.

26. The method according to claim 24, further comprising printing common variable information on a front surface of the face sheet on both sides of the line of perforations and cutting the second roll after each printing of variable information to provide composite forms.

* * * * *